US007414221B2

(12) United States Patent
Pratt, Sr. et al.

(10) Patent No.: US 7,414,221 B2
(45) Date of Patent: Aug. 19, 2008

(54) MEMORIALIZING WRISTBAND JEWELRY

(76) Inventors: Michael Pratt, Sr., 512 N. Spruce St., Valley, NE (US) 68064; Rita Pratt, 512 N. Spruce St., Valley, NE (US) 68064

( * ) Notice: Subject to any disclaimer, the term of this patent is extended or adjusted under 35 U.S.C. 154(b) by 187 days.

(21) Appl. No.: 11/360,649

(22) Filed: Feb. 23, 2006

(65) Prior Publication Data

US 2006/0185390 A1 Aug. 24, 2006

Related U.S. Application Data

(60) Provisional application No. 60/655,968, filed on Feb. 23, 2005.

(51) Int. Cl.
*B23K 26/38* (2006.01)
*A44C 17/00* (2006.01)

(52) U.S. Cl. ..... 219/121.69; 63/33; 29/896.411

(58) Field of Classification Search ..... None
See application file for complete search history.

(56) References Cited

U.S. PATENT DOCUMENTS 2,145,071 A * 1/1939 Cave ..... 63/3
2,413,541 A * 12/1946 Brady ..... 63/3
3,800,450 A * 4/1974 Laugherty et al. ..... 40/633
5,152,042 A * 10/1992 Mayers ..... 29/896.41
5,799,511 A * 9/1998 Benderly ..... 63/23
5,880,430 A * 3/1999 Wein ..... 219/121.69
6,003,228 A * 12/1999 Riggio ..... 29/896.41
D475,316 S * 6/2003 Skiles ..... D11/1
6,605,797 B1 * 8/2003 Troitski ..... 219/121.69
6,642,475 B2 * 11/2003 Benderly ..... 219/121.68
D495,869 S * 9/2004 Troitski et al. ..... D3/208
D509,636 S * 9/2005 Troitski ..... D99/5
2002/0092322 A1 * 7/2002 Zieverink ..... 63/33
2003/0024908 A1 * 2/2003 Benderly ..... 219/121.69
2006/0210820 A1 * 9/2006 Rutstein ..... 428/542.4
2007/0000284 A1 * 1/2007 Rosenwasser et al. ..... 63/32
2007/0214645 A1 * 9/2007 Citrenbaum ..... 29/896.4

* cited by examiner

*Primary Examiner*—Jack W. Lavinder

(57) ABSTRACT

A memorialization wristband jewelry includes an elongated semi-flexible metal plate strip having an top surface and a lower surface and a paint material applied in a generally even layer to the top surface of the metal plate strip. A memorialization image is formed in the paint material, the memorialization image being formed by removal of specific selected areas of the paint material from the top surface of the metal plate strip and the metal plate strip is then formed into a generally arcuate shape which approximates the outer circumferential shape of the human wrist whereby the memorialization wristband is wearable on the wrist of a person.

5 Claims, 1 Drawing Sheet

MEMORIALIZING WRISTBAND JEWELRY

CROSS-REFERENCE TO RELATED PROVISIONAL PATENT

This application claims priority based on a provisional patent, specifically on the Provisional Patent Application Ser. No. 60/655,968 filed Feb. 23, 2005.

BACKGROUND OF THE INVENTION

1. Technical Field

The present invention is directed to memorialization jewelry and, more particularly, to a memorializing wristband with a photolathed picture imprinted thereon, the wristband being formed of a semi-rigid metal such as aluminum or brass in a generally rectangular strip shape which is then coated on the top surface thereof with a colored, enamel lacquer paint, following which portions of the applied paint are selectively removed by means of a photolathing or laser etching process, and finally the metal strip is formed into a generally arcuate shape adapted to generally conform to the contours of the wrist of a person wearing the memorializing wristband of the present invention.

2. Description of the Prior Art

There are many different types of memorialization jewelry which are used to honor the memory of a particular person or persons or to symbolize an identification with a particular cause or charity. Examples of such types of jewelry include the "Live Strong" bracelets which are worn to illustrate identification with cancer victims and pink ribbons which are worn to illustrate awareness of the AIDS epidemic. Such memorialization jewelry is perfectly suitable for showing identification of the individual wearing the jewelry with a particular cause or charity, but it becomes more difficult to illustrate one's affection or affiliation with a particular person or persons by wearing a piece of jewelry, as there is no ready way to illustrate the person or persons with whom the individual wishes to identify. Of course, lockets and pendants holding a loved one's picture or lock of hair are well known in the prior art, but the disadvantages of such jewelry is that not all persons feel comfortable wearing such a pendant or locket, particularly those of the male persuasion. There is therefore a need for a piece of memorialization jewelry which may be worn by men, women, and children, in an unobtrusive and comfortable manner.

An additional need for such a piece of memorialization jewelry is that it will preferably illustrate the person, place or thing being memorialized in such a manner that the image being displayed is immediately recognizable to persons viewing the memorialization jewelry, and therefore the image must be of high detail and high quality. While photographs will fulfill this requirement, photographs are notoriously easy to damage and are also difficult to affix to most types of jewelry, including wristbands and the like. Engraving the image in a metal or plastic material is a possibility, but engraving cannot render the level of detail necessary for proper memorialization of the selected person, place or thing, and therefore is not well-suited for this purpose. There is therefore a need for an image imprinting process used in combination with memorialization jewelry which will produce high quality images which are durable and will properly honor the person, place or thing being memorialized.

Therefore, an object of the present invention is to provide a memorialization wristband jewelry which will include an image of the person, place or thing being memorialized.

Another object of the present invention is to provide a memorialization wristband jewelry which will include a high quality photoimage of the person, place or thing being memorialized such that other persons seeing the image can easily discern the nature of the image being presented.

Another object of the present invention is to provide a memorialization wristband jewelry which is constructed of a thin metal strip having a paint material applied to the top surface thereof, the paint material being removed via a photolathing process to expose the metal to produce a high quality image of the person, place or thing being memorialized on the jewelry.

Another object of the present invention is to provide a memorialization wristband jewelry which, after formation of the image thereon, is formed into a generally arcuate shape which approximates the outer circumferential shape of the human wrist whereby the memorialization wristband is wearable on the wrist of a person.

Another object of the present invention is to provide a memorialization wristband jewelry which can include many different colors and designs to properly and effectively memorialize virtually any different person, place, thing or event.

Finally, an object of the present invention is to provide a memorialization wristband jewelry which is relatively simple and durable in manufacturing and is safe, effective, and efficient in use.

SUMMARY OF THE INVENTION

The present invention provides a memorialization wristband jewelry including an elongated semi-flexible metal plate strip having an top surface and a lower surface and a paint material applied in a generally even layer to the top surface of the metal plate strip. A memorialization image is formed in the paint material, the memorialization image being formed by removal of specific selected areas of the paint material from the top surface of the metal plate strip and the metal plate strip is then formed into a generally arcuate shape which approximates the outer circumferential shape of the human wrist whereby the memorialization wristband is wearable on the wrist of a person.

As thus described, the memorialization wristband jewelry pad of the present invention provides numerous advantages over those various types of memorialization jewelry found in the prior art. For example, because the completed wristband will include a readily recognizable image displaying the person, place or thing which is being memorialized, the emotional power of the memorializing jewelry is far greater than other non-image bearing memorialization jewelry. Furthermore, because the memorialization wristband jewelry of the present invention displays an image which is durable and damage-resistant, the wearer need not be as concerned about damaging the jewelry, which will make it more likely that he or she will wear the memorialization wristband jewelry more often, thus increasing public exposure of the memorialization wristband jewelry and thus providing more situations for honoring the person, place or thing memorialized on the jewelry. Finally, because the present invention may display virtually any image thereon, virtually any person, place or thing to be memorialized can be incorporated into the memorialization wristband jewelry, thereby allowing a far greater number of persons to use the present invention. The memorialization wristband jewelry pad of the present invention thus provides a substantial improvement over those memorialization jewelry devices found in the prior art.

DESCRIPTION OF THE PREFERRED EMBODIMENT

Figure 1:
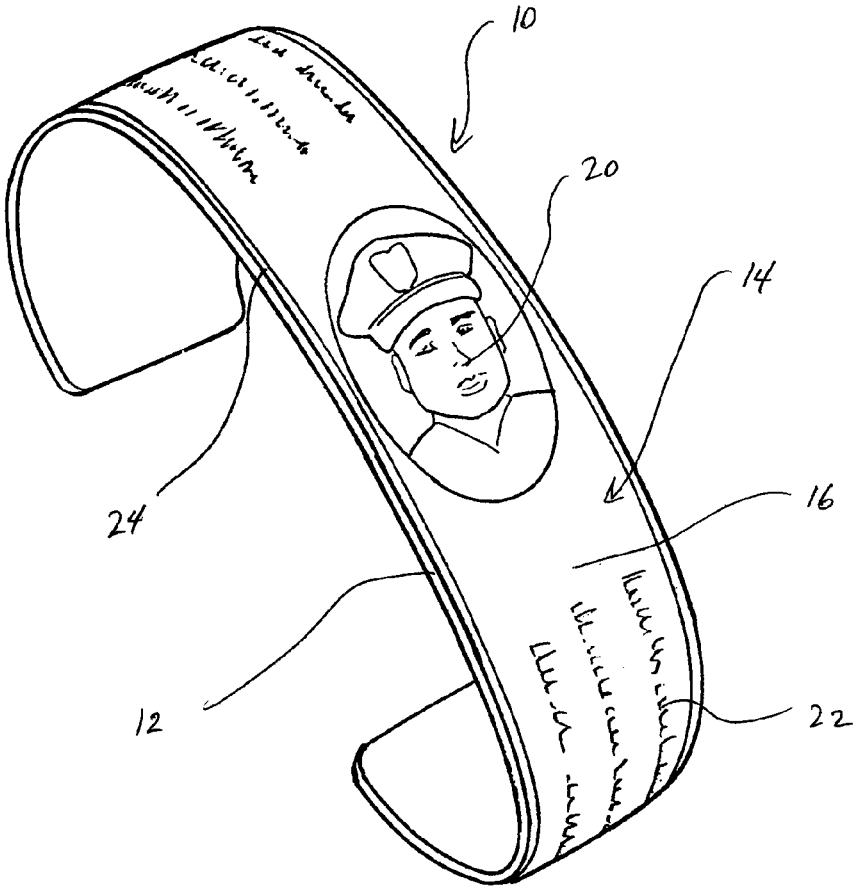
FIG. 1 is a perspective view of the memorializing wristband of the present invention.
Figure 2:
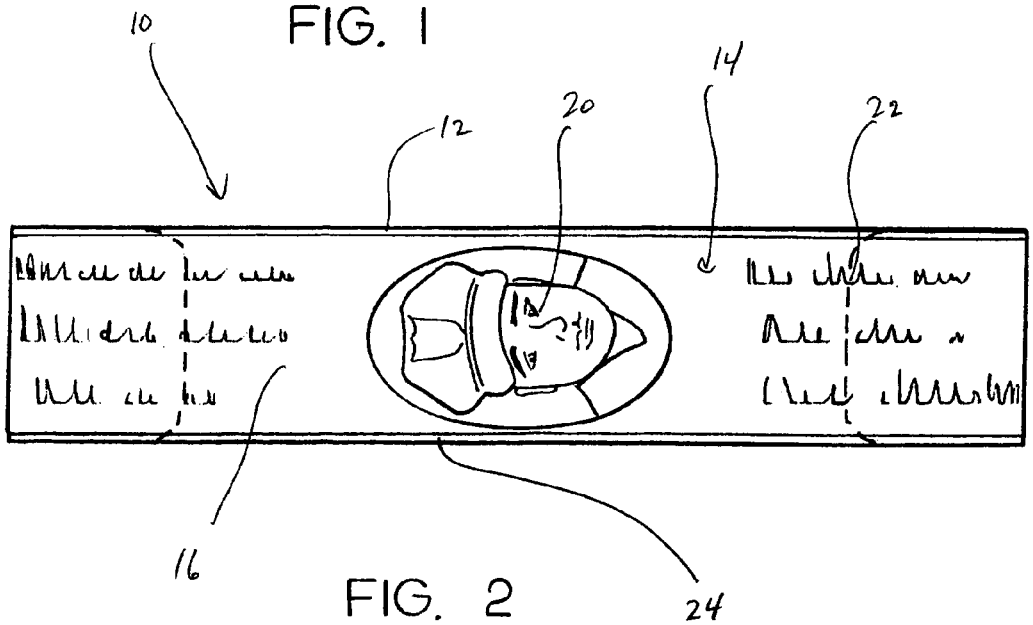
FIG. 2 is a top plan view of the memorializing wristband of the present invention.

The memorialization wristband 10 of the present invention is shown best in FIGS. 1 and 2 as including a generally flat, generally rectangular metal strip 12 which, in the preferred embodiment, would be constructed of aluminum or brass having a gauge thickness of approximately 0.025, although the precise thickness, size, and shape of the metal strip 12 is not critical to the present invention so long as it safely and comfortably fits around a wearer's wrist and is not so thick as to prevent bending of the metal strip in order to facilitate its fitting around the wrist of the individual wearing the present invention. Applied to the top surface 14 of metal strip 12 is a colored paint 16 which, in the preferred embodiment, would be an enamel lacquer paint which is generally opaque and of a pleasing and generally somber color, depending, of course, on the wishes of the eventual wearer of the memorialization wristband 10. It is preferred that the paint 16 be applied in a generally even layer to the top surface 14 of the metal strip 12, and it is important that the paint 16 applied to the metal strip 12 be of a type which may be flexed along with the metal strip 12 to prevent cracking and peeling of the paint 16 from the metal strip 12. Although it has been found that enamel lacquer paint works best for this purpose, virtually any type of functionally equivalent paint may be substituted for the enamel lacquer paint of the present invention without significantly degrading the functionality of the memorialization wristband 10 of the present invention.

Once the paint 16 has been applied to the metal strip 12, each of the corners of the metal strip 12 would be rounded to prevent the corners from catching on the individual's skin or clothing and the paint 16 would then be removed from the strip by a photolathing or laser etching process in which a photograph 20 of the person, place or thing being memorialized would be formed on the memorialization wristband 10, as shown best in FIGS. 1 and 2. At the same time, wording 22 or other such symbols may also be formed in the paint 16 on metal strip 12 by the photolathing process, the wording 22 potentially including memorialization enhancements, advertising for supporting business entities or other such additional descriptive materials. Also, it may be preferable to include a circumferential band 24 which would be lathed or etched around the top surface 14 of the metal strip 12 as shown in FIGS. 1 and 2 by removing the paint 16 which will highlight the photograph 20 and wording 22 and provide additional protection for the paint 16 remaining on top surface 14.

Once the photolathing process is complete, the memorialization wristband 10 is ready to be finally processed for use as a piece of memorialization jewelry. In general, photolathing involves the use of a very small and accurate lathe which is movably mounted on a frame and is guided by a photoelectric scanner to replicate the photograph in the paint 16 by removing sections of the paint 16 to reveal the underlying metal. The exact nature of the photolathing process is generally well-known in the prior art, however, its use in connection with memorialization jewelry is heretofore unknown.

The final step in the preparation of the memorialization wristband 10 for use on a wrist of an individual is to form the metal strip 12 into a generally arcuate shape which approximates the outer circumferential shape of the wrist of the wearer of the memorialization wristband 10, as shown best in FIG. 1. This bending process may be done in several different ways, but it has been found that bending the metal strip 12 over a wooden form approximating the shape of the wrist of an individual provides a generally accurate and comfortable replication of the shape of the wrist of the individual, thus permitting the memorialization wristband 10 to be worn as a piece of wrist jewelry. Of course, the metal strip 12 may be bent in several different appropriate ways, each of which would be understood by one skilled in the art of metal bending, but it should be noted that whatever the bending process applied to the metal strip 12 of the present invention, the important feature is that the general shape of the wrist be replicated by the bent metal strip 12 in order to permit the memorialization wristband 10 to be fitted onto the individual's wrist.

It is to be noted that numerous additions, substitutions, and modifications may be made to the memorialization wristband 10 of the present invention which fall within the intended broad scope of the above description. For example, the exact size, shape, and construction materials used in connection with the memorialization wristband 10 may be modified or changed so long as the intended functionality of the memorialization wristband is maintained. Also, the process by which the photograph of the person, place or thing to be affixed to the top surface 14 of the metal strip 12 may be modified or changed, although it has been found that laser etching or photolathing are the two best methods by which the photograph 20 and wording 22 may be best applied in the paint 16 on top surface 14 of metal strip 12. Finally, the precise nature of the photo 20 and memorialization wording 22 to be used in connection with the memorialization wristband 10 may be modified or changed depending on the individual or individuals who are being commemorated by the memorialization wristband 10, and such modifications would be understood by those skilled in the art.

There has therefore been shown and described a memorialization wristband 10 which accomplishes at least all of its intended purposes.

We claim:

1. A method of creating memorializing jewelry comprising the steps:

providing an elongated semi-flexible metal plate strip having an top surface and a lower surface;

applying a paint material in a generally even layer to said top surface of said metal plate strip;

forming a memorialization image in said paint material by removing specific selected areas of said paint material from said top surface of said metal plate strip; and forming said metal plate strip into a generally arcuate shape which approximates the outer circumferential shape of the human wrist whereby said memorialization wristband is wearable on the wrist of a person.

2. The method of creating memorialization wristband jewelry of claim 1 wherein said metal plate strip is constructed of one of aluminum and brass.

3. The method of creating memorialization wristband jewelry of claim 1 wherein said paint material comprises an enamel lacquer paint which is generally opaque.

4. The method of creating memorialization wristband jewelry of claim 1 wherein said step of forming a memorialization image in said paint material comprises photolathing said paint material, said photolathing consisting of applying a movably mounted lathe which is guided by a photoelectric scanner to replicate said memorialization image to said paint material to remove selected sections of said paint material to reveal the underlying metal of said metal plate strip.

5. The method of creating memorialization wristband jewelry of claim 1 wherein said step of forming said metal plate strip into a generally arcuate shape comprises bending of said metal plate strip over a rigid bending form approximating the outer circumferential shape of the human wrist whereby said memorialization wristband is wearable on the wrist of a person.

* * * * *